US006516538B2

(12) United States Patent
Kraft

(10) Patent No.: US 6,516,538 B2
(45) Date of Patent: Feb. 11, 2003

(54) BEACH SANDAL

(76) Inventor: Spencer Kraft, 1295 Sweetwater Cove Sterling Oaks Unit 8101, Naples, FL (US) 34110

( * ) Notice: Subject to any disclaimer, the term of this patent is extended or adjusted under 35 U.S.C. 154(b) by 0 days.

(21) Appl. No.: 09/792,595

(22) Filed: Feb. 26, 2001

(65) Prior Publication Data

US 2002/0116840 A1 Aug. 29, 2002

(51) Int. Cl.[7] ..... A43B 3/12; A43B 5/08; A43B 3/24; A43B 21/00

(52) U.S. Cl. ..... 36/11.5; 36/8.1; 36/101; 36/105

(58) Field of Search ..... 36/11.5, 100, 101, 36/87, 105, 8.1, 4, 15, 22 A, 23

(56) References Cited

U.S. PATENT DOCUMENTS 2,259,273 A * 10/1941 Smith ..... 36/11.5
4,068,395 A * 1/1978 Senter
4,180,872 A * 1/1980 Chaikin ..... 36/4
D260,047 S * 8/1981 Heinz
4,783,909 A * 11/1988 Van Doren et al.
4,817,302 A * 4/1989 Saltsman ..... 36/11.5
4,920,664 A * 5/1990 McGregor et al. ..... 36/11.5
5,463,823 A * 11/1995 Bell et al. ..... 36/11.5
RE35,452 E * 2/1997 Sargeant ..... 36/11.5
5,657,557 A * 8/1997 Hull et al. ..... 36/50.1
5,884,419 A * 3/1999 Davidowitz et al. ..... 36/50.1
5,937,542 A * 8/1999 Bourdeau ..... 36/50.5
5,960,565 A * 10/1999 Lochbaum ..... 36/11.5
6,021,585 A * 2/2000 Cole ..... 36/11.5
6,029,372 A * 2/2000 Pan ..... 36/11.5
6,237,252 B1 * 5/2001 Cook ..... 36/50.1
6,327,250 B1 * 5/2001 Aguerre ..... 36/11.5

* cited by examiner

*Primary Examiner*—Anthony D. Stashick
(74) *Attorney, Agent, or Firm*—Thomas R. Farino, Jr.

(57) ABSTRACT

The present invention relates to a thin sandal made for reef and river walking utilizing a sponge-top layer directly fixed to a rubber sole as well as a single continuous adjustable elastic strap.

5 Claims, 1 Drawing Sheet

BEACH SANDAL

The present patent application relates to an improved beach sandal of the type generally known as a flip-flop.

As it is known, beach sandals commonly known as flip-flops have been available on the market for some time. These sandals, generally of monolithic structure, feature a thin, one-piece sole with an attached strap which engages the foot between the first and second toes with little or no support to the rest of the foot.

Although very popular, traditional flip-flop beach sandals have, however, shown some functional disadvantages. The first one is due to the monolithic structure comprised of rubber or plastic and the lack of comfort associated with this composition.

Additionally, traditional flip-flop beach sandals have provided little or no support to the heel area of the foot, allowing the heel portion of the sandal to separate from the bottom heel portion of the foot, creating a safety problem while walking or running.

The purpose of the present invention is to realize a thin sandal (approximately 2.5 mm.) particularly adapted for reef and river walking. Comprised of two layers, a sponge top layer overcomes the lack-of-comfort issue associated with the prior art. A bottom sole layer made of rubber is bonded to the top layer by means of a PVC border. A continuous elastic strip is provided to create straps for engaging the front portion of the foot between the first and second toes and the heel portion of the foot by means of an adjustable heel member.

Because of its light weight (4 ozs.) and thinness (approximately 2.5 mm.), the novel sandal can be slipped into a user's pocket when he is swimming, surfing, etc. For example, in Indonesia, most surfing spots have reefs which must be negotiated prior to getting to the water. Thus, a user wears the sandal to protect his feet from the sharp coral until he reaches the water, at which point he slips the sandals into his pocket and surfs in his bare feet.

As an additional feature of this novel design, in case the sandals are dropped, due to their buoyancy, the novel sandals float on the surface of the water.

The novel adjustable heel member enables the user to create a snug fit in the heel area of the foot thus overcoming the safety problem associated with the prior art.

For major clarity, the description of the invention according to the present invention continues with references to the enclosed drawing, which is intended for purposes of illustration and not in a limiting sense, whereby:

Figure 1:
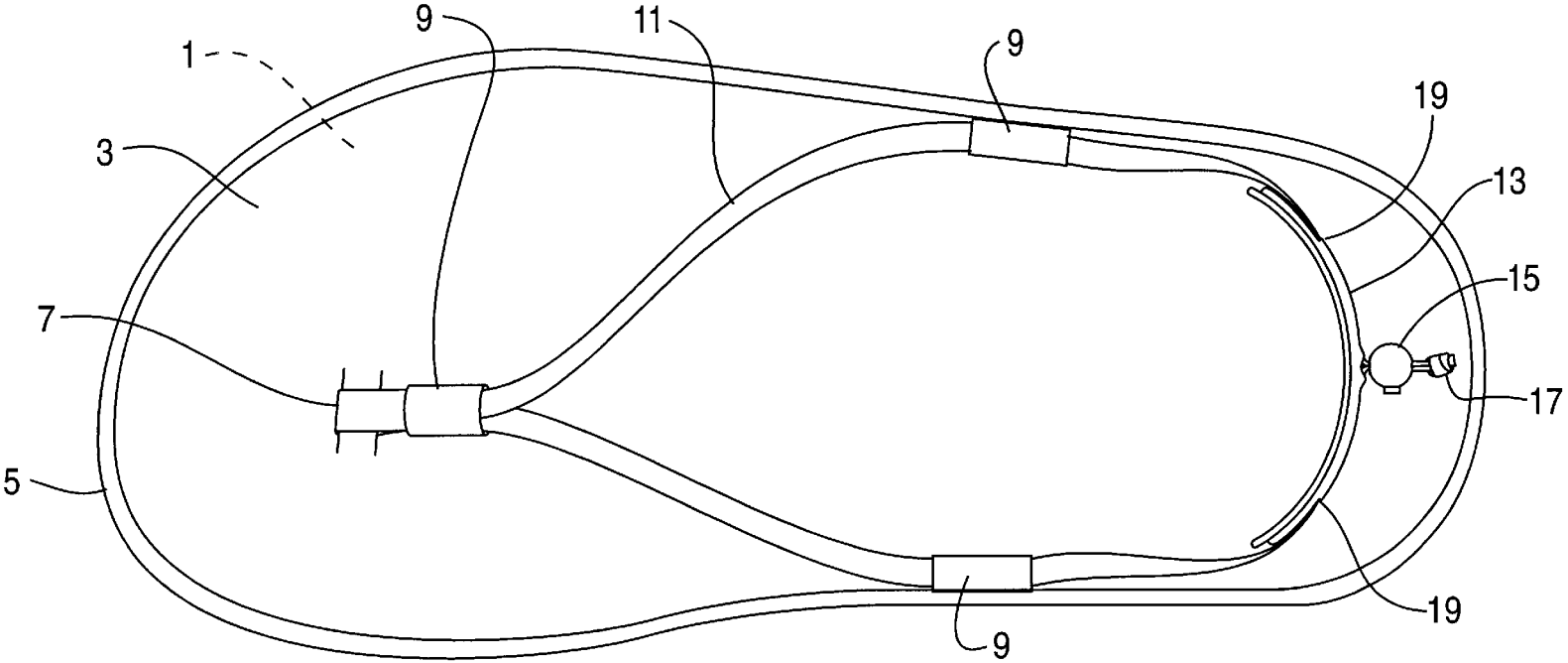
FIG. 1 is a top view of the beach sandal according to the present invention.
Figure 2:
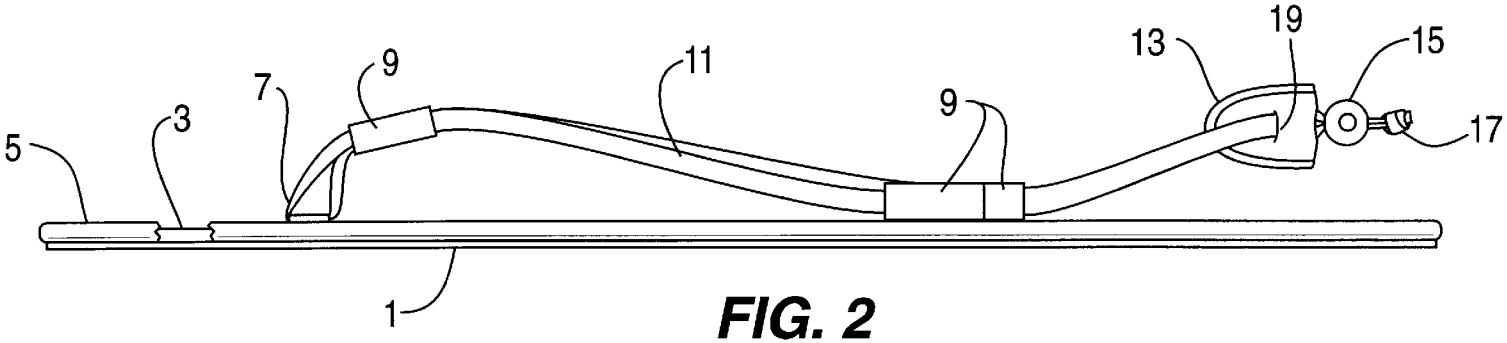
FIG. 2 is a view from the internal side of FIG. 1.

With reference to the above figures, the improved beach sandal, according to the present invention, comprises a rubber sole (1) joined to a sponge top layer (3) by means of a perimeter PVC base band (5).

Elastic band (11) comprises one continuous strap terminating in a knot (17). Band (11) is attached to the upper surface of sponge layer (3) by means of retention strip (7) and support guides (9).

Heel strap (13) is mounted on band (11) by means of slots (19). Locking nut (15) permits adjustment of heel member (13) so as to create a snug fit.

Thus, the improved sandal, according to the present invention, presents a light-weight, floatable, adjustable sandal with improved comfort and safety.

What is claimed is:

1. An improved sandal consisting of a top layer, a bottom sole layer and a perimeter base band;

a single continuous elastic strap member attached to said top layer;

said perimeter base band bonding said top layer to said bottom sole layer;

a plurality of support guides for retaining and positioning said elastic strap;

a heel member adjustably connected to said elastic strap;

a locking nut coupled to said elastic strap for adjusting said heel member;

said single continuous strap member being positioned between the first and second toes thus functioning to secure both the toe and heel portions of the user's foot.

2. The sandal, according to claim 1 wherein said top layer is comprised of sponge.

3. The sandal according to claim 1 wherein said sole layer is comprised of rubber.

4. The sandal according to claim 1 wherein said perimeter base band is comprised of PVC.

5. The sandal according to claim 1 wherein said support guides are comprised of PVC.

* * * * *